US010246303B2

(12) United States Patent
Lampinen et al.

(10) Patent No.: US 10,246,303 B2
(45) Date of Patent: Apr. 2, 2019

(54) ARRANGEMENT AND ELEVATOR

(71) Applicant: KONE Corporation, Helsinki (FI)

(72) Inventors: Riku Lampinen, Helsinki (FI); Hannu Lehtinen, Numminen (FI)

(73) Assignee: KONE CORPORATION, Helsinki (FI)

( * ) Notice: Subject to any disclaimer, the term of this patent is extended or adjusted under 35 U.S.C. 154(b) by 168 days.

(21) Appl. No.: 15/012,123

(22) Filed: Feb. 1, 2016

(65) Prior Publication Data

US 2016/0236909 A1 Aug. 18, 2016

(30) Foreign Application Priority Data

Feb. 12, 2015 (EP) ..... 15154843

(51) Int. Cl.
*B66B 15/02* (2006.01)
*B66B 15/04* (2006.01)
*B66B 9/00* (2006.01)

(52) U.S. Cl.
CPC ..... *B66B 15/02* (2013.01); *B66B 9/00* (2013.01); *B66B 15/04* (2013.01)

(58) Field of Classification Search
CPC ..... B66B 15/02; B66B 15/04; B66B 19/02; B66B 15/06; B66B 7/06; F16C 19/55; F16C 21/00
USPC ..... 384/461
See application file for complete search history.

(56) References Cited

U.S. PATENT DOCUMENTS

| | | | | |
|---|---|---|---|---|
| 3,332,665 | A * | 7/1967 | Bruns | B66D 3/06 187/254 |
| 6,405,833 | B1 * | 6/2002 | Baranda | B66D 3/08 187/251 |
| 6,419,208 | B1 | 7/2002 | Baranda et al. | |
| 2006/0175149 | A1 * | 8/2006 | Det | B66B 7/027 187/406 |
| 2026/0169542 | | 8/2006 | Liebetrau et al. | |

FOREIGN PATENT DOCUMENTS

| | | | |
|---|---|---|---|
| CN | 1346329 | A | 4/2002 |
| CN | 101023286 | A | 8/2007 |
| CN | 103171946 | A | 6/2013 |
| CN | 203199840 | U | 9/2013 |
| EP | 1916450 | A1 | 4/2008 |
| EP | 2 406 165 | A1 | 1/2012 |
| JP | 5-278974 | A | 10/1993 |
| JP | 05278974 | A * | 10/1993 |
| JP | 2003-306281 | A | 10/2003 |

(Continued)

*Primary Examiner* — Diem M Tran
(74) *Attorney, Agent, or Firm* — Birch, Stewart, Kolasch & Birch, LLP

(57) ABSTRACT

An arrangement for guiding belt-shaped ropes of an elevator includes a plurality of belt-shaped ropes; and a rope wheel deck including a frame mounted on a structure of an elevator, a plurality of rope wheels for guiding ropes of the elevator, and plurality of bearings, wherein the rope wheels are cambered and mounted coaxially on the frame via the bearings such that they are rotatable relative to the frame as well as relative to each other, wherein only one belt-shaped rope passes around each of said rope wheels of the rope wheel deck. An elevator implements the arrangement for guiding belt-shaped ropes of an elevator.

12 Claims, 5 Drawing Sheets

(56) References Cited

FOREIGN PATENT DOCUMENTS

| | | | |
|---|---|---|---|
| WO | WO 00/59819 | A2 | 10/2000 |
| WO | WO 2009/090299 | A1 | 7/2009 |
| WO | WO 2010/103165 | A1 | 9/2010 |

* cited by examiner

ARRANGEMENT AND ELEVATOR

FIELD OF THE INVENTION

The invention relates to an arrangement for guiding belt-shaped ropes of an elevator and an elevator, the elevator being an elevator for transporting passengers and/or goods.

BACKGROUND OF THE INVENTION

An elevator typically comprises an elevator car and a counterweight, which are vertically movable in a hoistway. These elevator units are typically interconnected by ropes (later referred to as upper ropes) that suspend these elevator units on opposite sides of one or more rope wheels mounted higher than the elevator units. For providing force for moving the suspension ropes, and thereby also for the elevator units, one of the wheels is typically a drive wheel engaging the upper ropes. In addition to the upper ropes, the elevator may need to be interconnected by ropes which hang from the elevator car and the counterweight. This type of ropes (later referred to as lower ropes) are often used to provide compensation for the weight of the hoisting ropes. Particularly, in this way the unbalance, which is caused by the upper ropes in situations where the elevator car is run to its extreme position, can be eliminated. However, these ropes may alternatively or additionally be used to provide so called tie-down function for the elevator. The upper ropes and/or the lower ropes may be belt-like.

A challenge with the solutions of prior art has been to guide the ropes with non-driven rope wheels such that reliable guidance for the ropes in axial direction of the rope wheels is provided. One proposed way of guiding ropes of an elevator is cambered shape of the rope wheel. In prior art, it has been proposed that the ropes can pass around a rope wheel having a cambered shape for each of the ropes. The cambered shape of the rope wheel circumference has a tendency to centralize the belt-shaped rope to pass along the peak of the cambered shape. However, it has been noticed that when using cambered guidance, some unintended behavior is occasionally encountered in some conditions. It has been noticed particularly, that a big part of the unintended behaviour is a result of tension differences between adjacent ropes and between successive parts of individual rope which are on opposite sides of a rope wheel. The tension differences, on the other hand, have been noticed to result meaningfully from variations in location of the rope on the cambered shape. That is, adjacent ropes can momentarily pass at different points of the cambered shape. This kind of variations are illustrated in FIG. 1 of the application. Tension differences may also be caused by rope wheel diameter tolerances and rope dimension tolerances. Due to one or more of these reasons it results that individual ropes are turned with slightly different diameters as compared to each other. As a result, excessive tension can be formed for parts of individual ropes. Because the ropes share the rope wheel, the tension can be released only by sliding of the overtensioned individual ropes along the rope wheel. However, this is unwanted as such due to the increase of rope wear it causes. On the other hand, should the engagement of ropes be very firm, such as based on very high friction, the slipping can be avoided but the downside is that loose rope is formed on the less tensioned parts of the rope. For example, with D530 rope wheel, adjacent ropes are at worst turned with roughly 1.8 mm different diameters, which can mean 0.33% slip over the rope wheel in the long run. If this is combined with high friction coefficient between the rope wheel and the rope, and long travel distances, the ropes are reeved so unequally that rope forces start varying remarkably. This may lead to poor rope life time or even rope damages if loose rope starts touching to other elevator components.

BRIEF DESCRIPTION OF THE INVENTION

The object of the invention is to provide an improved arrangement for guiding belt-shaped ropes of an elevator as well as an improved elevator having belt-shaped ropes. An object is particularly, to provide a solution alleviating problems related to guidance of belt-shaped ropes with cambered rope wheel shapes. An object is particularly to alleviate one or more of the above defined problems of prior art and/or problems discussed or implied elsewhere in the description. It is brought forward such embodiments, inter alia, wherein problematic effect caused by unequal position of some of the belts of the elevator can be neutralized. Alternative configurations are presented by which one or more of the objects and/or advantages can be achieved.

It is brought forward a new arrangement for guiding belt-shaped ropes of an elevator comprising a plurality of belt-shaped ropes. The arrangement further comprises a rope wheel deck comprising a frame mounted on a structure of an elevator, a plurality of rope wheels for guiding ropes of the elevator, and plurality of bearings, wherein the rope wheels are cambered and mounted coaxially on the frame via the bearings such that they are rotatable relative to the frame as well as relative to each other. In the arrangement, only one belt-shaped rope passes around each of said rope wheels of the rope wheel deck. With this configuration, one or more of the above mentioned advantages and/or objectives are achieved. In particular, each rope wheel can guide ropes rotating on the frame while being able to turn independently of state of the other rope wheels for equalizing belt tension on opposite sides of each cambered rope wheel. The arrangement for guiding belt-shaped ropes of an elevator is preferably further implemented with one or more of the preferred features described in the following.

In a preferred embodiment, the rope wheels are not fixed to each other and each rope wheel can rotate on the frame independently of rotation of any other rope wheel of the rope wheel deck.

In a preferred embodiment, the rope wheels are non-driven rope wheels.

In a preferred embodiment, the rope wheels are mounted coaxially on the frame via the bearings more specifically such that they are freely, i.e. in a manner unlimited by any means of the rope wheel deck, rotatable relative to the frame as well as relative to each other. Thus, each rope wheel can rotate an unlimited angle and number of revolutions relative to each of the other rope wheels of the rope wheel pack as well as the frame. Thus, each rope wheel is free to turn independently of state of the other rope wheels as much as it is needed for equalizing belt tension on opposite sides of each cambered rope wheel. Thus, problems in rope behavior can be alleviated effectively in elevators where the travel distances are long.

In a preferred embodiment, said plurality of bearings includes rolling bearings, such as roller or ball bearings, and/or one or more sliding bearings.

In a preferred embodiment, the rope wheel deck comprises a central shaft (also referred to as the shaft) common to all said rope wheels, via which all the rope wheels are mounted on the frame. The shaft can be made non-rotatable or rotatable relative to the frame.

In the first kind of embodiments, wherein the shaft is non-rotatable relative to the frame, it is preferable that said plurality of bearings comprises per each of the rope wheels at least one bearing radially between the rope wheel and the shaft. Then, only one rope wheel is mounted via each said at least one bearing. In one embodiment of this kind, said plurality of bearings comprises per each of the rope wheels only one bearing radially between the rope wheel and the shaft. In another embodiment of this kind, said plurality of bearings comprises per each of the rope wheels two bearings radially between the rope wheel and the shaft. In an embodiment of this kind, it is preferable that said plurality of bearings comprises sliding contact bearings in axial direction between rope wheels next to each other, preferably such that all the rope wheels next to each other have a sliding contact bearing in axial direction between them. In an embodiment of this kind, it is likewise preferable that each said bearing radially between a rope wheel and the shaft is a rolling bearing. Each of the rolling bearings then preferably comprises an inner ring member mounted immovably on the shaft to surround it, rolling members distributed along the circumference of the inner ring member, and an outer ring member mounted immovably on one of the rope wheels to surround the inner ring member such that the rolling members are between them. The embodiment can be implemented such that outermost rope wheel(s) have two bearings radially between it and the shaft, and each of the other rope wheels have only one bearing radially between it and the shaft, and all the rope wheels next to each other have a sliding contact bearing in axial direction of the shaft between them.

In the first kind of embodiments, wherein the shaft is non-rotatable relative to the frame, the rope wheel deck can alternatively comprise a hollow cylinder surrounding the shaft, the wall of the hollow cylinder being radially between the rope wheels and the shaft. Then, said plurality of bearings comprises at least one bearing radially between the shaft and the cylinder, and a bearing radially between each of the rope wheels and the cylinder. Then preferably each rope wheel is mounted on the cylinder rotatably independently of rotation of any other rope wheels of the rope wheel deck via said bearing radially between it and the cylinder. Preferably, said bearing radially between each rope wheel and the cylinder is a sliding contact bearing. Preferably, each said bearing radially between the shaft and the cylinder is a rolling bearing. Each of the rolling bearings is preferably such that it comprises an inner ring member mounted immovably on the shaft to surround it, rolling members (here balls) distributed along the circumference of the inner ring member, and an outer ring member mounted immovably on the cylinder to surround the inner ring member such that the rolling members are between the inner and the outer ring member.

In the second kind of embodiments, wherein the shaft is rotatable relative to the frame, the shaft is mounted on the frame via bearings rotatably relative to the frame, the bearings preferably being rolling bearings, such as roller or ball bearings. Preferably one of the rope wheels is non-rotatable relative to the shaft and said plurality of bearings comprises a bearing radially between each of the other rope wheels and the shaft. This is preferably implemented such that said plurality of bearings comprises per each of the other rope wheels at least one bearing radially between the rope wheel and the shaft. Only one of the other rope wheels is thereby mounted via each said at least one bearing. Said bearing radially between each rope wheel and the shaft is a sliding contact bearing. It is preferable that each of said other rope wheels is mounted on the shaft rotatably independently of rotation of any other rope wheels of the rope wheel deck via said bearing radially between it and the cylinder.

The belt-shaped ropes are preferably such that they comprise each one or plurality of load bearing members adjacent in width direction of the rope for bearing the load exerted on the rope in longitudinal direction thereof, which load bearing member(s) is/are embedded in a coating forming the surface of the rope, which surface rests against the cambered circumference of a rope wheel. Preferably, said coating is made of polymer material, such as polyurethane, whereby good protection as well as high friction is provided for the rope. In this context, the tension equalizing of the rope wheel pack is particularly advantageous as with this kind of rope sliding between the rope wheel and the rope is not likely or possible and thereby with some of the ropes on one side of the rope wheel the rope tension might be drop dangerously low due to resistance of the other rope wheels for equalizing the tension.

It is also brought forward a new elevator implementing an arrangement for guiding belt-shaped ropes of an elevator described anywhere above. The elevator comprises a hoistway, an elevator car and a counterweight vertically movable in the hoistway; a plurality of belt-shaped ropes interconnecting the elevator car and counterweight; an arrangement for guiding the belt-shaped ropes, the arrangement comprising a rope wheel deck comprising a frame mounted on a structure of an elevator, and a plurality of rope wheels for guiding ropes of the elevator, and plurality of bearings, the rope wheels being cambered and mounted coaxially on the frame via the bearings such that they are rotatable relative to the frame as well as relative to each other; and wherein only one belt-shaped rope passes around each of said rope wheels of the rope wheel deck. With this configuration, one or more of the above mentioned advantages and/or objectives are achieved.

The elevator preferably comprises a plurality of ropes (upper ropes) passing around rope wheels located higher than the car and counterweight, and a plurality of ropes (lower ropes) passing around lower rope wheels located lower than the car and counterweight.

Said plurality of belt-shaped ropes can be lower or upper ropes of the elevator. In the first case, said plurality of belt-shaped ropes hang from the elevator car and a counterweight and said rope wheel deck is mounted lower than the car and counterweight, such as within the lower end of the hoistway. Guidance with the deck as presented is particularly advantageous in this context, because with lower ropes the rope tension is low, and thereby the above mentioned tension issues are most clearly problematic in this context. In the first case, it is preferable that said rope wheel deck is mounted on a stationary structure of the elevator, which is preferably the floor of the hoistway. Preferably, each of said belt-shaped ropes forms a U-shaped loop hanging from the car and counterweight inside which loop one of said rope wheels is located. In the latter case, said plurality of belt-shaped ropes suspend the elevator car and counterweight on opposite sides of the rope wheels of the rope wheel deck and said rope wheel deck is mounted higher than the car and counterweight, such as within the upper end of the hoistway or a machine room adjacent or above the upper end of the hoistway. Then, said rope wheel deck is preferably mounted on a stationary structure of the elevator, which is preferably the floor of a machine room or a stationary structure of the hoistway (such as a beam). The elevator preferably comprises a drive wheel for moving the upper ropes. Of course, it is further possible that both the upper ropes and the lower ropes can are arranged as described.

Said elevator is preferably an elevator for transporting passengers and/or goods. For this purpose, the elevator comprises a car that has an interior space suitable for receiving a passenger or passengers and/or load to be lifted. The elevator is preferably such that the car thereof is arranged to serve two or more landings. The elevator preferably controls movement of the car in response to calls from landing and/or destination commands from inside the car so as to serve persons on the landing(s) and/or inside the elevator car.

BRIEF DESCRIPTION OF THE DRAWINGS

In the following, the present invention will be described in more detail by way of example and with reference to the attached drawings, in which.

The foregoing aspects, features and advantages of the invention will be apparent from the drawings and the detailed description related thereto.

DETAILED DESCRIPTION

Figure 1:
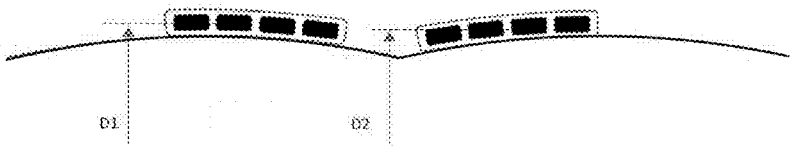
FIG. 1 illustrates rope guiding arrangement according to one piece of prior art.

FIG. 1 illustrates an arrangement for guiding ropes according to prior art. The ropes next to each other pass along a cambered circumference, but at different points of the cambered shape. Thus, one of the ropes turns with diameter D1 and the other with diameter D2, which are not equal. This has been noticed to cause problematic tension differences in ropes of the elevator, which may or may not be manifested as sliding of rope along the rope wheel in some cases and as slackness of rope on one side of a rope wheel in cases wherein rope engagement is too firm for sliding.

Figure 2:
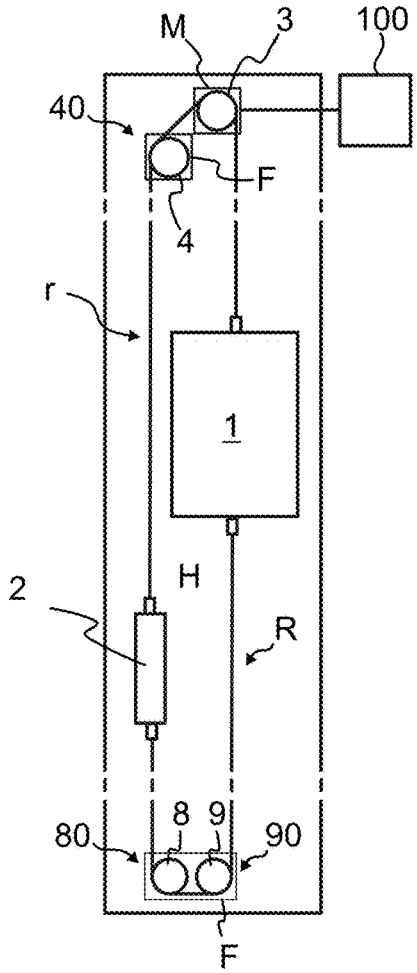
FIG. 2 illustrates an embodiment of an elevator implementing an arrangement for guiding belt-shaped ropes according to the invention.

FIG. 2 illustrates an elevator according to a preferred embodiment. The elevator comprises a hoistway H, and an elevator car 1 and a counterweight 2, which are vertically movable in the hoistway H. The car 1 and a counterweight 2 are interconnected by ropes r (also referred to as upper ropes) suspending the car 1 and the counterweight 2 as well as by ropes R (also referred to as lower ropes) that hang from the elevator car 1 and the counterweight 2.

The lower ropes R are belt-shaped, and thereby substantially larger in width direction than in thickness direction. The elevator comprises an arrangement for guiding the lower ropes R, the guiding arrangement comprising at least one rope wheel deck (here two) 80,90, each rope wheel deck comprising a plurality of coaxially mounted rope wheels 8,9 for guiding the ropes. The ropes R pass side by side (as viewed in width direction of the belt-shaped ropes R) via the at least one rope wheel deck 80,90 of non-driven rope wheels 4,8,9. In the illustrated embodiment, also the upper ropes r are belt-shaped, and thereby substantially larger in width direction than in thickness direction. The elevator comprises an arrangement for guiding the upper ropes r, the guiding arrangement comprising at least one rope wheel deck (here one) 40 of non-driven rope wheels 4,8,9. The rope wheel deck 40 comprising a plurality of coaxial mounted rope wheels 4 for guiding the upper ropes r. The ropes r pass side by side (as viewed in width direction of the belt-shaped ropes r) via the rope wheel deck 40.

Figure 3:
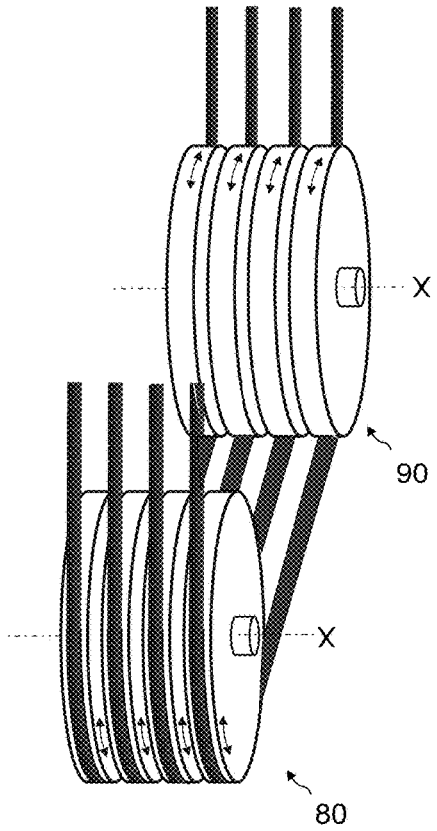
FIG. 3 illustrates an arrangement for guiding belt-shaped lower ropes of an elevator.
Figure 4:
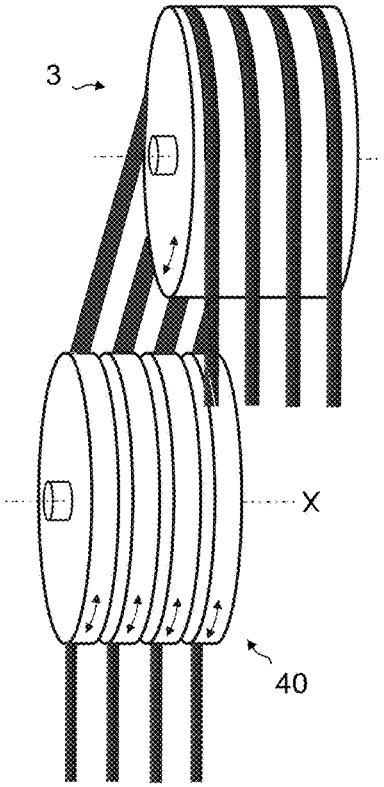
FIG. 4 illustrates an arrangement for guiding belt-shaped upper ropes of an elevator.
Figure 5:
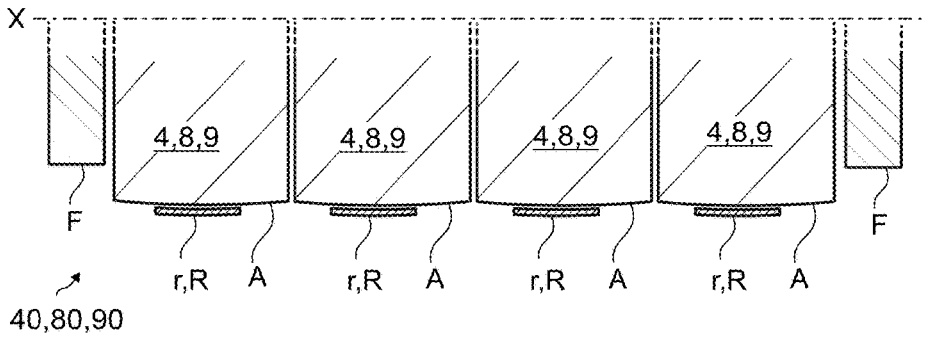
FIG. 5 illustrates cross-section of a rope wheel deck and the ropes guided by it.

Each rope wheel 4,8,9 of said rope wheel deck 40,80,90 are cambered, whereby the position (in axial direction of the rope wheel) of each rope on the circumference of the rope wheel around which it turns, is controlled. The rope wheel deck 40,80,90 comprises a frame F mounted on a structure of an elevator, and as mentioned a plurality of rope wheels 4,8,9 for guiding ropes of the elevator, one for each ropes passing via the rope wheel deck 40,80,90. Each rope wheel 4,8,9 is arranged to guide (only) one of the ropes r,R. Each rope wheel deck 40,80,90 comprises a plurality of bearings, and the rope wheels 4,8,9 are mounted coaxially on the frame F via the bearings such that they are rotatable relative to the frame F as well as relative to each other. Each rope wheel 4,8,9 is thus rotatable relative to the frame F as well as relative to each and any of the other rope wheels of said rope wheel deck. The rope wheels 4,8,9 are not fixed to each other so they can rotate relative to each other. Each rope wheel 4,8,9 can rotate on the frame F independently of rotation of any other rope wheels 4,8,9 of the rope wheel deck 40,80,90. Each belt-shaped lower rope r passes around only one of said rope wheels 4,8,9 of the rope wheel deck 40,80,90. FIG. 3 illustrates three-dimensionally the rope wheel decks 80,90, the rope wheels 8,9 of which are arranged to guide the lower ropes R, and FIG. 4 illustrates three-dimensionally the rope wheel deck 40 the rope wheels 4 of which are arranged to guide the upper ropes r. FIG. 5 illustrates cross-section of the rope wheel deck 40,80,90 and the ropes r,R guided by it. As visible, each rope r,R passes along a cambered circumference of a rope wheel 4,8,9. Each cambered rope wheel has a circumference with a curved convex shaped cross section. A rope is placed to pass its wide side (i.e. the side extending in width direction of the rope) resting against the circumference with the curved convex shaped cross section.

FIGS. 6 to 10 illustrate preferred alternative embodiments of the rope wheel deck 40,80,90 of said arrangement for guiding the belt-shaped ropes r,R.

Figure 6:
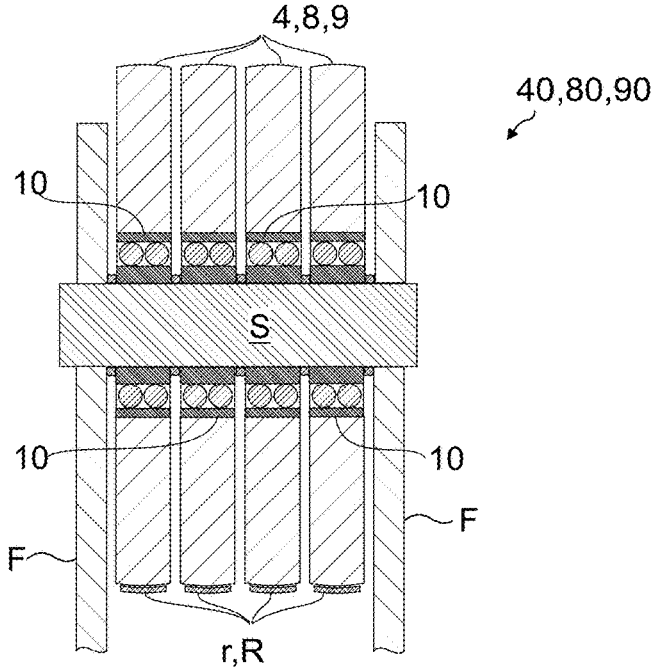
FIGS. 6 to 10 illustrate preferred detailed embodiments for the rope wheel deck.

FIG. 6 illustrates preferred details for the rope wheel deck 40,80,90 according to a first alternative. In this case, the rope wheel deck 40,80,90 comprises a central shaft S common to all said rope wheels, via which all the rope wheels 4,8,9 of the rope wheel deck 40,80,90 are mounted on the frame F. The rope wheels 4,8,9 are mounted coaxially on the frame F via plurality of bearings 10 such that they are rotatable relative to the frame F as well as relative to each other. In the rope wheel deck 40,80,90 illustrated in FIG. 6, said plurality of bearings 10 comprises per each of the rope wheels 4,8,9 one bearing 10 radially between the rope wheel 4,8,9 and the shaft S. Only one rope wheel 4,8,9 is mounted via each of said bearings 10. In this embodiment, the shaft S is immovable relative to the frame. These bearings 10 are in this case rolling bearings. Each of the rolling bearings 10 comprises a inner ring member mounted immovably on the shaft S to surround it, rolling members (here balls) distributed along the circumference of the inner ring member, and an outer ring member mounted immovably on one of the rope wheels to surround the inner ring member such that the rolling members are between them. The rope wheels 4,8,9 are not fixed to each other so they can rotate relative to each other.

Figure 7:
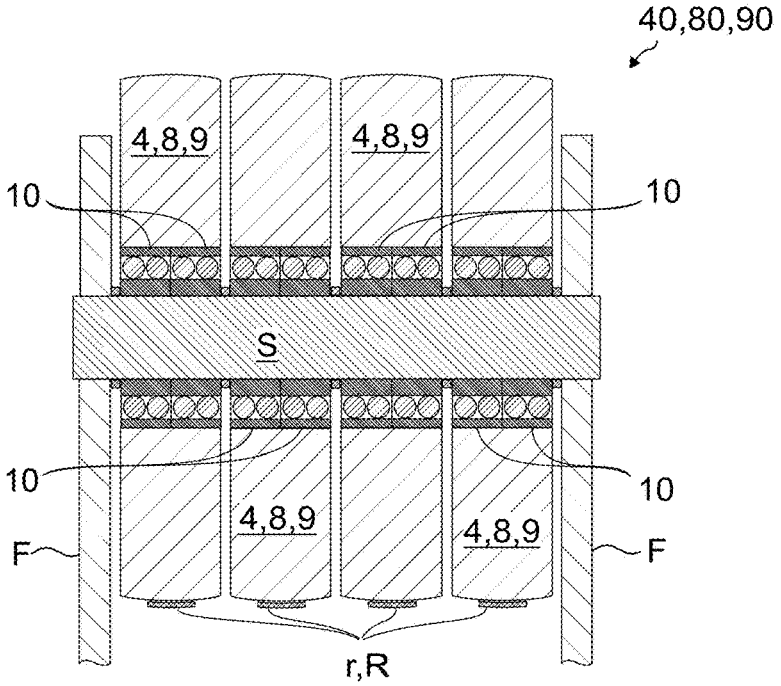

FIG. 7 illustrates preferred details for the rope wheel deck 40,80,90 according to a second alternative. In this case, the rope wheel deck 40,80,90 comprises a central shaft S common to all said rope wheels, via which all the rope wheels 4,8,9 of the rope wheel deck 40,80,90 are mounted on the frame F. The rope wheels 4,8,9 are mounted coaxially on the frame F via plurality of bearings 10 such that they are rotatable relative to the frame F as well as relative to each other. In the rope wheel deck 40,80,90 illustrated in FIG. 7, said plurality of bearings 10 comprises per each of the rope wheels 4,8,9 two bearings 10 radially between the rope wheel 4,8,9 and the shaft S. Only one rope wheel 4,8,9 is mounted via each said two bearings 10. The bearings 10 are in this case rolling bearings. Each of the rolling bearings 10 comprises a inner ring member mounted immovably on the shaft S to surround it, rolling members (here balls) distributed along the circumference of the inner ring member, and an outer ring member mounted immovably on one of the rope wheels to surround the inner ring member such that the rolling members are between them. The rope wheels 4,8,9 are not fixed to each other so they can rotate relative to each other. In this embodiment, the shaft S is immovable relative to the frame.

Figure 8:
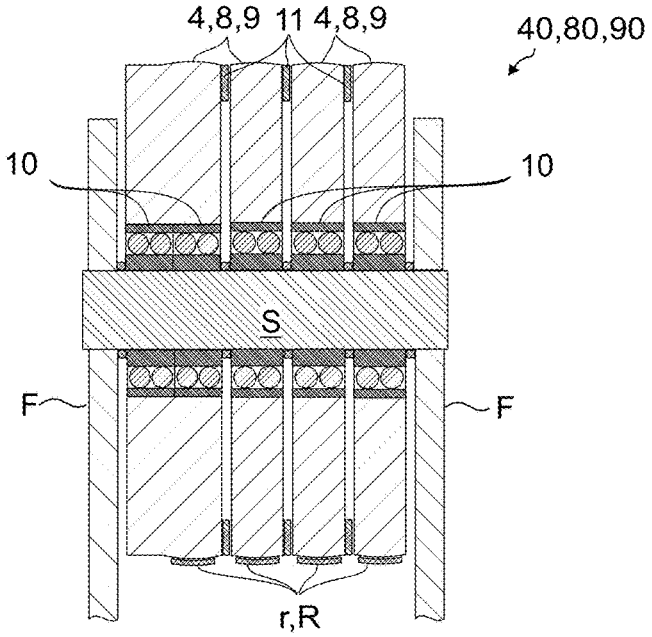

FIG. 8 illustrates preferred details for the rope wheel deck 40,80,90 according to a third alternative. In this case, the rope wheel deck 40,80,90 comprises a central shaft S common to all said rope wheels, via which all the rope wheels 4,8,9 of the rope wheel deck 40,80,90 are mounted on the frame F. The rope wheels 4,8,9 are mounted coaxially on the frame F via the bearings 10,11 such that they are rotatable relative to the frame F as well as relative to each other. In the rope wheel deck 40,80,90 illustrated in FIG. 8, said plurality of bearings 10,11 comprises per each of the rope wheels 4,8,9 at least one bearing 10 radially between the rope wheel 4,8,9 and the shaft S. Only one rope wheel 4,8,9 is mounted via each said of said bearings 10. Said plurality of bearings 10,11 further comprises sliding contact bearings 11 (also known as plain bearings) in axial direction X between rope wheels 4,8,9 next to each other. In this case, all the rope wheels 4,8,9 next to each other have a sliding contact bearing 11 in axial direction X between them. In the illustrated case, the outermost (the leftmost wheel) rope wheel has two bearings 10 radially between it and the shaft S, and each of the other rope wheels have only one bearing radially between it and the shaft, and the rope wheels next to each other have a sliding contact bearing in axial direction of the shaft between them. Thus, the rope wheels next to each other are configured to lean on each other via the sliding contact bearing. This is preferable (although not necessary) because the two bearings provide more firm positioning and the wheel mounted via said two bearings is able to support firmly the other rope wheels in axial direction via the sliding contact bearing 11 connection. The bearings 10 radially between the rope wheels 4,8,9 and the shaft S are preferably rolling bearings, as illustrated. The rope wheels 4,8,9 are not fixed to each other so they can rotate relative to each other. In this embodiment, the shaft S is immovable relative to the frame. So as to facilitate fitting of the two bearings for the outermost rope wheel, this has been made thicker in axial direction x than the other rope wheels. Each of the rolling bearings 10 comprises a inner ring member mounted immovably on the shaft S to surround it, rolling members (here balls) distributed along the circumference of the inner ring member, and an outer ring member mounted immovably on one of the rope wheels to surround the inner ring member such that the rolling members are between them.

Figure 9:
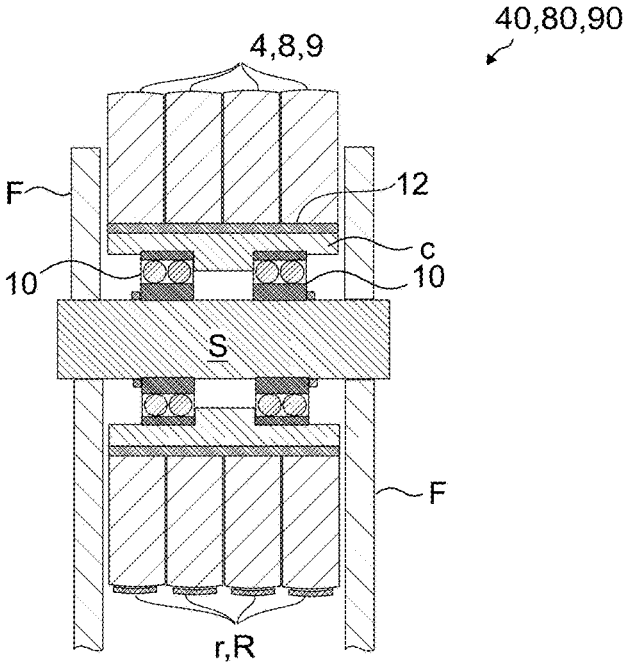

FIG. 9 illustrates preferred details for the rope wheel deck 40,80,90 according to a fourth alternative. In this case, the rope wheel deck 40,80,90 comprises a central shaft S common to all said rope wheels, via which all the rope wheels 4,8,9 of the rope wheel deck 40,80,90 are mounted on the frame F. The rope wheels 4,8,9 are mounted coaxially on the frame F via the bearings such that they are rotatable relative to the frame F as well as relative to each other. The rope wheel deck 40,80,90 illustrated in FIG. 9, comprises a hollow cylinder c, which is surrounds the shaft S placed inside the hollow cylinder c. In this embodiment, the shaft S is immovable relative to the frame F. The wall of the cylinder c is radially between all the rope wheels 4,8,9 and the shaft S. Said bearings 10,12 comprise at least one bearing 10 (here 2 of them) provided radially between the shaft S and the cylinder c, and a bearing 12 radially between each of the other rope wheels 4,8,9 and the cylinder c. Thus, the cylinder c is rotatable relative to the shaft S, which is immovable relative to the frame F. On the other hand, the bearing 12 provided radially between each of the other rope wheels 4,8,9 and the cylinder c provide that they are rotatable relative to the cylinder c. This configuration makes it possible that the bearings 10 between the shaft S and the cylinder c can be made suitable for high rpm and the bearing 12 between each of the other rope wheels and the cylinder can be made suitable for low rpm. The rope wheels 4,8,9 are not fixed to each other so they can rotate relative to each other. Each rope wheel 4,8,9 is mounted on the cylinder c rotatably independently of rotation of any other rope wheels 4,8,9 of the rope wheel deck 40,80,90 via said bearing 12 radially between it 4,8,9 and the cylinder c. The relative rotation between the rope wheels 4,8,9 is practically always low in speed, whereas the relative rotation between all the rope wheels 4,8,9 and the shaft is during movement of the elevator car 1 always high in speed. With this configuration, rotation of rope wheels relative to each other can thus be provided by cheap and simple bearings, and the bearing suitable for high rpm can be made common for them all. Thus an individual bearing suitable for high rpm need not be provided for each of the rope wheels 4,8,9. Rolling bearings are well suitable for high rpm. Sliding contact bearings are cheap and simple and suitable for low rpm. Accordingly, it is preferable, that each said at least one bearing 10 radially between the shaft S and the cylinder c is a rolling bearing and said bearing 12 radially between each of the other rope wheels and the cylinder c is a sliding contact bearing, as illustrated in FIG. 9. Each of the rolling bearings 10 comprises an inner ring member mounted immovably on the shaft S to surround it, rolling members (here balls) distributed along the circumference of the inner ring member, and an outer ring member mounted immovably on the cylinder c to surround the inner ring member such that the rolling members are between the inner and the outer ring member. In FIG. 9, there is one common sliding contact bearing 12 radially between all the rope wheels 4,8,9 and the cylinder c. The sliding contact bearing 12 is here in the form of a bushing surrounding the cylinder c and having an outer surface whereto all the rope wheels 4,8,9 are slidably mounted. Alternatively, several adjacent bushings could be used, whereby each rope wheel would have its own sliding contact bearing 12, as it's the case with solution of FIG. 10.

Figure 10:
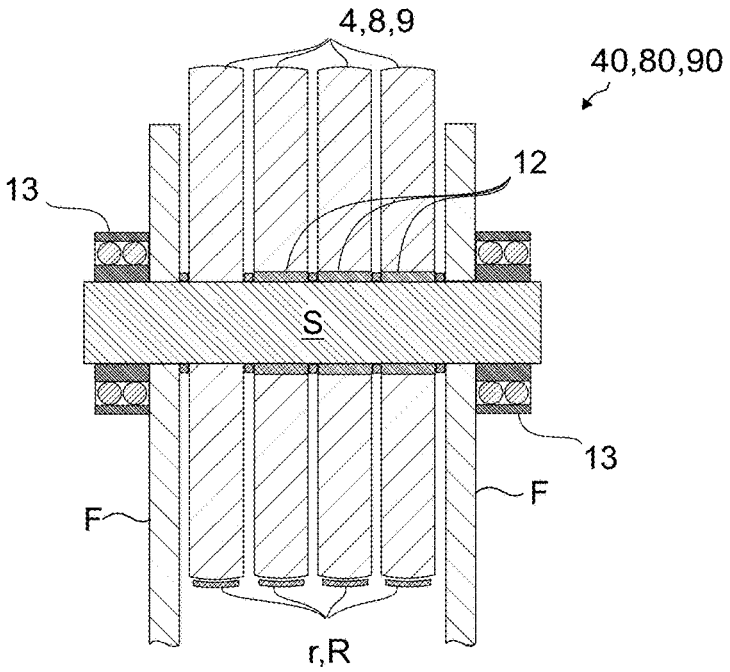

FIG. 10 illustrates preferred details for the rope wheel deck 40,80,90 according to a fifth alternative. The rope wheels 4,8,9 are mounted coaxially on the frame F via the bearings 12,13 such that they are rotatable relative to the frame F as well as relative to each other. In this case, the rope wheel deck 40,80,90 comprises a central shaft S common to all said rope wheels 4,8,9 via which all the rope wheels 4,8,9 of the rope wheel deck 40,80,90 are mounted on the frame F. The rope wheels 4,8,9 are not fixed to each other so they can rotate relative to each other. In the rope wheel deck 40,80,90 illustrated in FIG. 10, said plurality of bearings 12,13 comprises bearings 13 via which the shaft S is mounted rotatably on the frame F. Accordingly, the shaft S is rotatable relative to the frame F. This is implemented such that the bearings 13 comprise a first bearing and a second bearing 13 mounted stationary on frame parts of the frame F and accommodating the rope wheels 4,8,9 between them. The first and second bearing 13 support opposite ends of the shaft S. One of the rope wheels 4,8,9 (the leftmost in FIG. 10) is non-rotatable relative to the shaft S. The shaft S being rotatable by the bearings 13, the rope wheel fixed thereto is rotatable relative to the frame F. In this embodiment, the relative rotation between rope wheels is provided by making the other rope wheels rotatable relative to each other as well as relative to the shaft S whereto the one rope wheel is non-rotatably mounted. For this purpose, said plurality of bearings 12,13 comprises further a bearing 12 radially between each of the other rope wheels 4,8,9 and the shaft S.

The shaft S rotates with high rpm during movement of the elevator car 1 as it is non-rotatable relative to said one rope wheel having a circumferential speed corresponding to speed of the rope passing around it. The other rope wheels are likely to rotate with the same or close to same rpm as said one rope wheel (the leftmost in FIG. 10) as they are each rotated by the ropes moving along with the car 1 movement, as it is the case with said one rope wheel. Thus, during movement of the elevator car 1 the relative rotation between individual rope wheels 4,8,9 as well as between the each rope wheel 4,8,9 and the shaft S is practically always low in speed, whereas the relative rotation between the shaft S and the frame D is practically always high in speed. Thus a bearing suitable for high rpm need not be provided for facilitating movement of the other rope wheels 4,8,9 relative to each other and said one rope wheel. Sliding contact bearings are cheap and simple and suitable for low rpm. Thus, said bearing 12 provided radially between each rope wheel 4,8,9 and the shaft S is preferably a sliding contact bearing, as illustrated. Rolling bearings are well suitable for high rpm. Accordingly, it is preferable, that said bearings 13 are rolling bearings. In this case, each of the rolling bearings comprises an inner ring member mounted immovably on the shaft S to surround it, rolling members (here balls) distributed along the circumference of the inner ring member, and an outer ring member mounted immovably on the frame F to surround the inner ring member such that the rolling members are between them. In the embodiment presented, said plurality of bearings 12,13 more specifically comprises per each of the other rope wheels 4,8,9 a bearing 12 radially between the rope wheel 4,8,9 and the shaft S. Only one rope wheel 4,8,9 is thereby mounted via each said of said bearings 12. Each sliding contact bearing 12 is here in the form of a bushing surrounding the shaft S and having an outer surface whereto only one of the rope wheels 4,8,9 are slidably mounted. Here, only one of the other rope wheels is mounted via each said at least one bearing radially between the rope wheel 4,8,9 and the shaft S. Alternatively, instead of several bushings a bushing could be used, which would surround the shaft S and have an outer surface whereto all the other rope wheels 4,8,9 are slidably mounted, as described with FIG. 9. In any case, each of said other rope wheels 4,8,9 is mounted on the shaft S rotatably independently of rotation of any other rope wheels 4,8,9 of the rope wheel deck 40,80,90 via said bearing(s) 12 radially between it and the shaft S.

In general, said frame is preferably such that it comprises a first frame part (face plate on the left in FIGS. 5 to 10) and a second frame part (face plate on the right in FIGS. 5 to 10), supporting the shaft S common to all said rope wheels 4,8,9, and the rope wheels 4,8,9 are accommodated between them. In the embodiments, where the shaft is non-rotatable relative to the frame F, it is preferable that the rope wheel deck comprises a fixing means (not showed) for fixing the shaft non-rotatably to the frame F, for example by means disclosed in European patent application EP2406165 A1.

In general, said rolling bearings can be ball bearings as disclosed in Figures but alternatively they may be roller bearings, for example.

Figure 11:
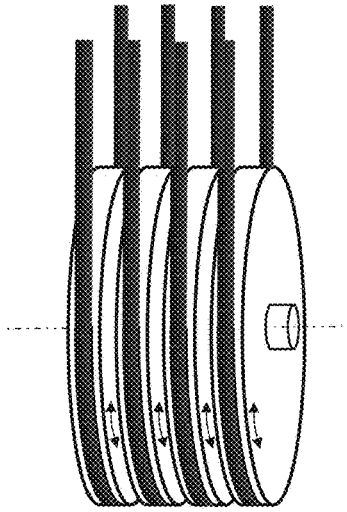
FIG. 11 illustrates an alternative arrangement for guiding belt-shaped lower ropes of an elevator.

When there are two rope wheel decks, as disclosed in FIGS. 2 and 3, these may have a common frame F. However, it is not necessary that the ropes are arranged to pass via more than one rope wheel deck. In FIG. 11, a further alternative is disclosed wherein there is only one of said rope wheel decks via which the lower ropes R pass.

The rope wheels 4,8,9 are mounted coaxially on the frame F via the bearings in particular such that they are freely, i.e. in a manner unlimited by any means of the rope wheel deck, rotatable relative to the frame F as well as relative to each other. Thus, each rope wheel 4,8,9 can rotate an unlimited angle and number of revolutions relative to the other rope wheels of the rope wheel deck as well as the frame F.

As illustrated, the upper ropes r pass around the rope wheels 4 of the rope wheel deck 40. In the preferred embodiment, they pass moreover around a drive wheel 3 engaging all said upper ropes r. The drive wheel 3 is provided for moving the upper ropes, and thereby also the car 1 and counterweight 2 interconnected by the upper ropes R. The elevator preferably also comprises an elevator control 100 for automatically controlling an electric motor M arranged to rotate the drive wheel 3.

The belt-shaped ropes r,R are preferably such that they comprise each one or plurality of load bearing members adjacent in width direction of the rope for bearing the load exerted on the rope in longitudinal direction thereof, which load bearing member(s) is/are embedded in a coating forming the surface of the rope, which surface rests against the cambered circumference of a rope wheel. Preferably, said coating is made of polymer material, such as polyurethane, whereby good protection as well as high friction is provided for the rope. In this context, the tension equalizing of the rope wheel pack is particularly advantageous as with this kind of rope sliding between the rope wheel and the rope is not possible and thereby with some of the ropes on one side of the rope wheel the rope tension might be drop dangerously low due to resistance of the other rope wheels for equalizing the tension. The ropes have preferably width thickness ratio more than 2, so as to ensure it has an efficient guidance and engagement with the cambered rope wheel, and/or a feasible turning radius. The rope structure can be in accordance with the rope disclosed in international patent application WO2009090299A1, for instance. The presented solutions for guidance of belt-shaped ropes can of course be utilized with other kind of belt-shaped ropes, alternatively. Also, the presented solutions for guidance of belt-shaped ropes can of course be utilized in some other kind of elevator than disclosed in the application, alternatively.

It is to be understood that the above description and the accompanying Figures are only intended to teach the best way known to the inventors to make and use the invention. It will be apparent to a person skilled in the art that the inventive concept can be implemented in various ways. The above-described embodiments of the invention may thus be modified or varied, without departing from the invention, as appreciated by those skilled in the art in light of the above teachings. It is therefore to be understood that the invention and its embodiments are not limited to the examples described above but may vary within the scope of the claims.

The invention claimed is:

1. An arrangement for guiding belt-shaped ropes of an elevator comprising:

a plurality of belt-shaped ropes;

a rope wheel deck comprising a frame mounted on a structure of an elevator, a plurality of rope wheels for guiding ropes of the elevator, and a plurality of bearings, wherein the rope wheels are cambered and mounted coaxially on the frame via the bearings such that they are rotatable relative to the frame as well as relative to each other; and a hollow cylinder surrounding the central shaft, a wall of the hollow cylinder being radially between the rope wheels and the central shaft, wherein only one belt-shaped rope passes around each of said rope wheels of the rope wheel deck, and the plurality of bearings comprise a bearing which is radially between each of the rope wheels and the cylinder and supports each and every one of the rope wheels such that all of the rope wheels are rotatable relative to the hollow cylinder.

2. The arrangement according to claim 1, wherein said plurality of bearings includes at least one of rolling bearings and one or more sliding contact bearings.

3. The arrangement according to claim 2, wherein the rope wheel deck comprises a central shaft common to all said rope wheels.

4. The arrangement according to claim 1, wherein the rope wheel deck comprises a central shaft common to all said rope wheels.

5. The arrangement according to claim 4, wherein the central shaft is non-rotatable relative to the frame.

6. The arrangement according to claim 5, wherein said plurality of bearings comprises at least one bearing radially between the shaft and the cylinder.

7. The arrangement according claim 6, wherein each rope wheel is mounted on the cylinder rotatably independently of rotation of any other rope wheels of the rope wheel deck via said bearing radially between each rope wheel and the cylinder.

8. The arrangement according to claim 6, wherein each said bearing radially between the shaft and the cylinder is a rolling bearing.

9. The arrangement according to claim 1, wherein said bearing radially between each rope wheel and the cylinder is a sliding contact bearing.

10. An elevator comprising:

a hoistway;

an elevator car and a counterweight vertically movable in the hoistway;

a plurality of belt-shaped ropes interconnecting the elevator car and counterweight; and an arrangement for guiding the belt-shaped ropes, the arrangement comprising:

a rope wheel deck comprising a frame mounted on a structure of an elevator, and a plurality of rope wheels for guiding the ropes of the elevator, and a plurality of bearings, the rope wheels being cambered and mounted coaxially on the frame via the bearings such that they are rotatable relative to the frame as well as relative to each other; and a hollow cylinder surrounding the central shaft, a wall of the hollow cylinder being radially between the rope wheels and the central shaft, wherein only one belt-shaped rope passes around each of said rope wheels of the rope wheel deck, and the plurality of bearings comprise a bearing which is radially between each of the rope wheels and the cylinder and supports each and every one of the rope wheels such that all of the rope wheels are rotatable relative to the hollow cylinder.

11. The elevator according to claim 10, wherein said plurality of belt-shaped ropes hang from the elevator car and a counterweight and said rope wheel deck is mounted lower, than the elevator car and counterweight.

12. The elevator according to claim 10, wherein said plurality of belt-shaped ropes suspend the elevator car and counterweight on opposite sides of the rope wheels of the rope wheel deck and said rope wheel deck is mounted higher than the car and counterweight.

* * * * *